US011428223B2

(12) United States Patent
Lee et al.

(10) Patent No.: US 11,428,223 B2
(45) Date of Patent: Aug. 30, 2022

(54) ROTARY COMPRESSOR WITH WEAR AVOIDING PORTION

(71) Applicant: LG ELECTRONICS INC., Seoul (KR)

(72) Inventors: Jingyu Lee, Seoul (KR); Hyeongseok Kim, Seoul (KR); Yonghyeon Sung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 16/838,285

(22) Filed: Apr. 2, 2020

(65) Prior Publication Data

US 2020/0362857 A1 Nov. 19, 2020

(30) Foreign Application Priority Data

May 17, 2019 (KR) ..... 10-2019-0058245

(51) Int. Cl.
*F04C 18/324* (2006.01)
*F01C 21/08* (2006.01)

(52) U.S. Cl.
CPC ..... *F04C 18/324* (2013.01); *F01C 21/0809* (2013.01); *F04C 2240/20* (2013.01); *F04C 2250/20* (2013.01); *F04C 2270/16* (2013.01)

(58) Field of Classification Search
CPC ..... F04C 18/324; F04C 2240/20; F04C 2250/20; F04C 2270/16; F01C 21/0809
See application file for complete search history.

(56) References Cited

U.S. PATENT DOCUMENTS 11,225,970 B2 * 1/2022 Lee ..... F01C 21/102

FOREIGN PATENT DOCUMENTS

CN 203412766 U * 1/2014
JP 2010-168977 8/2010
JP 2010168977 A * 8/2010
(Continued)

OTHER PUBLICATIONS

Machine Translation of Korean Patent Publication KR 2013-0117982, Inventor: Ho et al, Title: Vane-Rotor and Vacuum Pump Using the Same, Published: Oct. 29, 2013. (Year: 2013).*
(Continued)

*Primary Examiner* — Mary Davis
(74) *Attorney, Agent, or Firm* — Ked & Associates

(57) ABSTRACT

A rotary compressor may include a rotary shaft; a plurality of plates that supports the rotary shaft; a cylinder provided between the plurality of plates to define a compression space, and provided with a vane slot; a roller slidably coupled to the rotary shaft inside of the cylinder, and having a hinge groove on an outer circumferential surface thereof; and a vane, a first end which is slidably coupled to the vane slot of the cylinder, and a second end of which is rotatably coupled to the hinge groove of the roller. At least one of axial end surfaces of the roller facing the plurality of plates is provided with a wear avoiding portion having a predetermined depth. Contact surfaces between the roller and the plate may be suppressed from being in close contact with each other to suppress the roller or the plate from being damaged or a performance of the compressor due to friction loss from being deteriorated, thereby improving reliability and performance of the compressor.

16 Claims, 14 Drawing Sheets

(56) References Cited

FOREIGN PATENT DOCUMENTS

| | | |
|---|---|---|
| KR | 10-2013-0117982 | 10/2013 |
| KR | 10-2014-0086492 | 7/2014 |
| KR | 10-2016-0034071 | 3/2016 |
| KR | 10-2019-0011141 | 2/2019 |
| WO | WO 2016/043439 | 3/2016 |

OTHER PUBLICATIONS

European Search Report dated Aug. 4, 2020.

* cited by examiner

ROTARY COMPRESSOR WITH WEAR AVOIDING PORTION

CROSS-REFERENCE TO RELATED APPLICATION(S)

Pursuant to 35 U.S.C. § 119(a), this application claims the benefit of an earlier filing date of and the right of priority to Korean Patent Application No. 10-2019-0058245, filed on May 17, 2019, the contents of which are incorporated by reference herein in its entirety.

BACKGROUND

1. Field

A rotary compressor, and more particularly, a rotary compressor in which a roller and a vane are coupled to each other are disclosed herein.

2. Background

A rotary compressor compresses refrigerant using a roller performing an orbiting movement in a compression space of a cylinder and a vane in contact with an outer circumferential surface of the roller to partition the compression space of the cylinder into a plurality of spaces. The rotary compressor may be divided into a rolling piston type and a hinge vane type according to whether the roller and the vane are coupled to each other. The rolling piston type is a type in which the vane is detachably coupled to the roller so that the vane is closely attached to the roller, and the hinge vane type is a type in which the vane is hinge-coupled to the roller. KR1020160034071A (hereinafter "Patent Document 1") and JP2010-168977A (hereinafter "Patent Document 2" each discloses a hinge vane type, the hinge vane type having a stable vane behavior compared to the rolling piston type, thereby reducing axial leakage.

However, in the rotary compressor, a compression reaction force is generated in the compression space during the compression process, and the roller receives a force in an axial direction by this compression reaction force. At this time, there exists a gap due to tolerance between the roller and the vane, and plates located at both sides of the roller. This gap causes a tilting phenomenon in which the roller is inclined to one side with respect to an axial center during operation, and the roller and the plate collide with or press against each other. In particular, severe wear may occur in a portion of the roller located at the discharge side with respect to the vane as a thermal deformation amount greatly increases compared to the other portion.

In a rolling piston type rotary compressor, as the roller is not constrained to the vane, when the roller is tilted and collides with the plate during operation, the compressor may be quickly restored to a posture capable of avoiding collision. Because of this, the rolling piston type may prevent wear that may occur between the roller and the plate in advance.

In contrast, in a hinge vane type rotary compressor, as the roller is constrained to the vane, even when the roller is tilted and collides with the plate, the compressor continues to rotate with respect to the plate in a collided or pressed state without being quickly restored to a posture capable of avoiding collision. For this reason, in the hinge vane type, wear between the roller and the plate may severely occur. In particular, in the hinge vane type, as a position of the roller is almost fixed by the vane, a thermal deformation amount at a portion of the roller located on the discharge side increases. As a result, in the hinge vane type, wear between the roller and the plate may be further increased, thereby reducing compressor efficiency. Wear between the roller and the plate is not taken into consideration in the roller disclosed in Patent Document 1 and Patent Document 2, and a communication path disclosed in Patent Document 2 is provided at one end surface of the roller to merely secure a discharge path, and such a problem may still occur in Patent Document 1, as well as Patent Document 2.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a rotary compressor according to embodiments will be described with reference to the accompanying drawings. The rotary compressor according to embodiments may be classified into a single rotary compressor or a double rotary compressor according to a number of cylinders. The embodiments relates to an axial side shape of a roller or a plate facing the roller in a hinge vane type rotary compressor in which the roller and a vane are coupled to each other. Therefore, the embodiments may be applied to both a single rotary compressor or a double rotary compressor. Hereinafter, a single rotary compressor will be described as an example, but the same description may also be applicable to a double rotary compressor.

Figure 1:
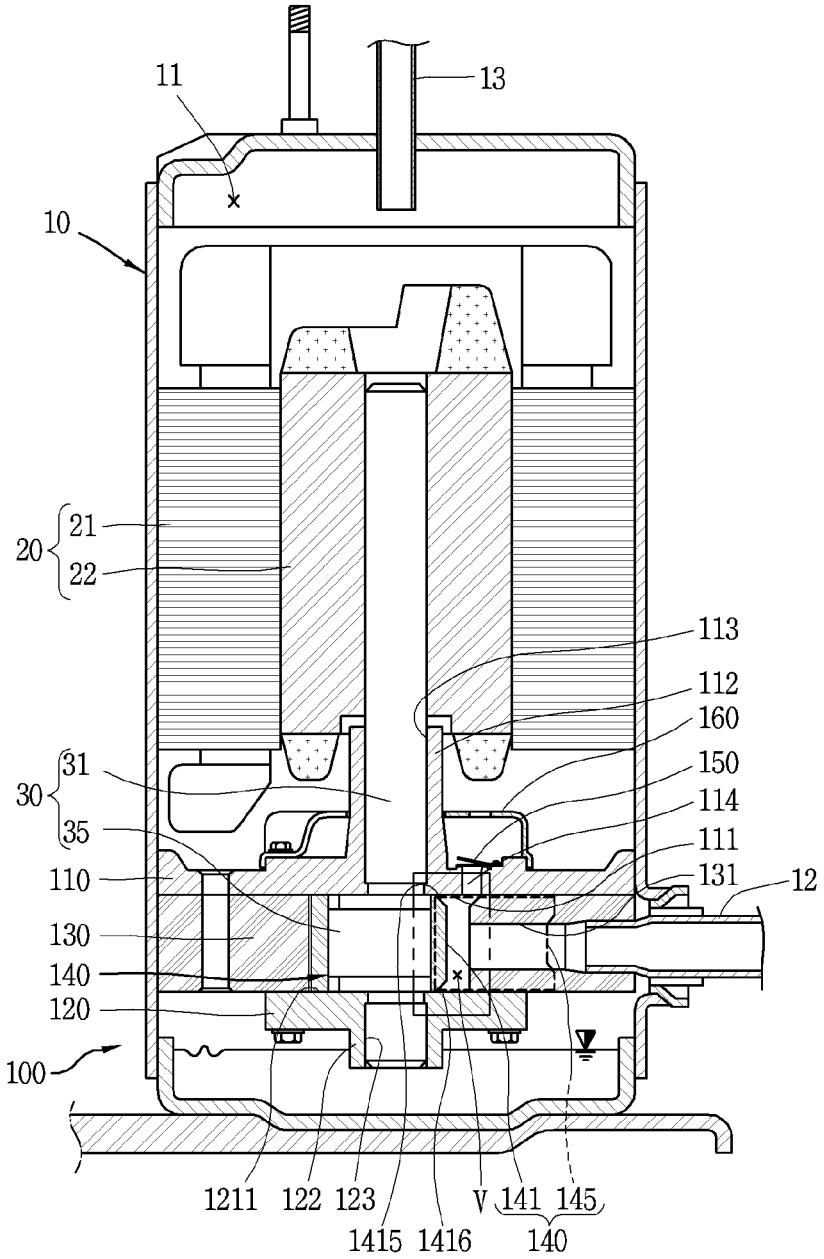
FIG. 1 is a longitudinal cross-sectional view showing a rotary compressor according to an embodiment.
Figure 2:
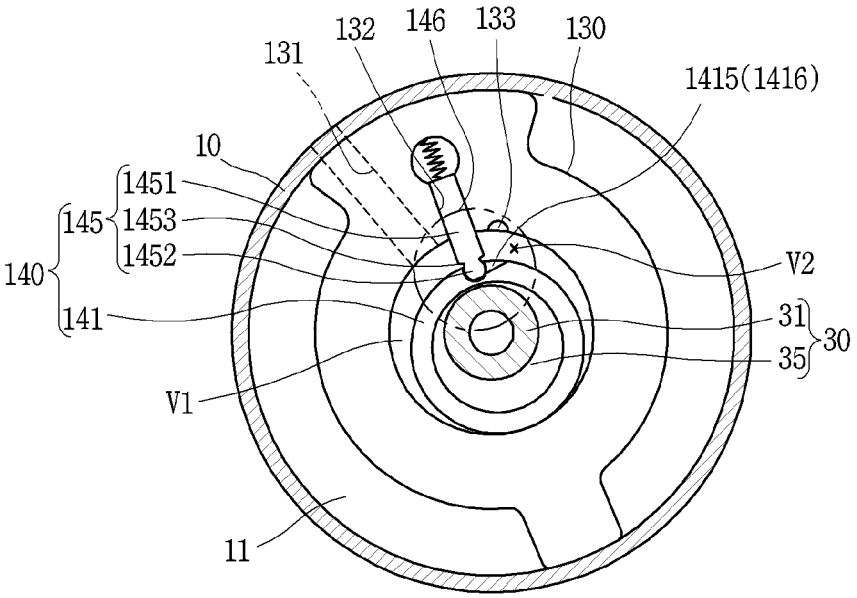
FIG. 2 is a transverse cross-sectional view showing a compression unit in the rotary compressor according to FIG. 1.
Figure 3:
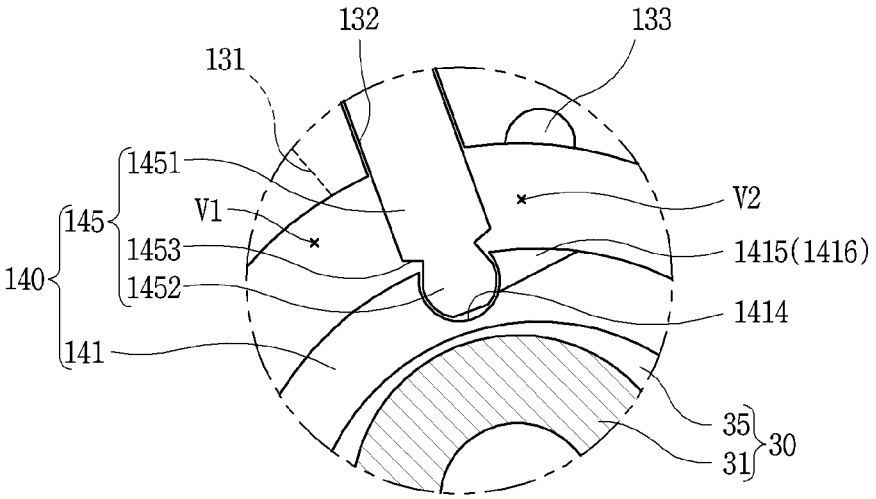
FIG. 3 is an enlarged transverse cross-sectional view showing a coupling portion between a roller and a vane in a vane roller according to FIG. 2.

FIG. 1 is a longitudinal cross-sectional view showing a rotary compressor according to an embodiment. FIG. 2 is a transverse cross-sectional view showing a compression unit in the rotary compressor according to FIG. 1. FIG. 3 is an enlarged transverse cross-sectional view showing a coupling portion between a roller and a vane in a vane roller according to FIG. 2.

Referring to FIGS. 1 and 2, in the rotary compressor according to an embodiment, an electric motor unit or electric motor 20 may be provided in an inner space 11 of a casing 10, and a compression unit 100 mechanically connected by a rotary shaft 30 may be provided in the inner space 11 of the casing 10 at a lower side of the electric motor unit 20.

The electric motor unit 20 may include a stator 21, for example, press-fitted and fixed to an inner circumferential surface of the casing 10 and a rotor 22 rotatably inserted into the stator 21. The rotary shaft 30 may be press-fitted and coupled to the rotor 22. An eccentric portion 35 is disposed eccentrically with respect to a shaft portion 31 in the rotary shaft 30, and a roller 141 of a vane roller 140, which will be described hereinafter, may be slidably coupled to the eccentric portion 35.

The compression unit 100 may include a main plate 110, a sub plate 120, a cylinder 130, and a vane roller 140. The main plate 110 and the sub plate 120 may be provided at both axial sides with the cylinder 130 interposed therebetween to define a compression space (V) inside of the cylinder 130. In addition, the main plate 110 and the sub plate 120 support the rotary shaft 30 passing through the cylinder 130 in a radial direction. The vane roller 140 may be coupled to the eccentric portion 35 of the rotary shaft 30 to compress refrigerant while performing an orbiting movement in the cylinder 130.

The main plate 110 may be defined in a disk shape, and side wall portion or side wall 111 may be, for example, shrink-fitted or welded to an inner circumferential surface of the casing 10 at an edge thereof. A main shaft receiving portion 112 may be disposed at a center of the main plate 110 to protrude upward, and a main shaft receiving hole 113 may be disposed at the main shaft receiving portion 112 to pass therethrough such that the rotary shaft 30 is inserted and supported thereto.

A discharge port 114 in communication with the compression space (V) to discharge refrigerant compressed in the compression space (V) to the inner space 11 of the casing 10 may be disposed at one side of the main shaft receiving portion 112. In some cases, the discharge port may be disposed in the sub plate 120 instead of the main plate 110.

The sub plate 120 may be defined in a disc shape and bolt-fastened, for example, to the main plate 110 together with the cylinder 130. Of course, when the cylinder 130 is fixed to the casing 10, the main plate 110 may be bolt-fastened, for example, to the cylinder 130 and the sub plate 120, respectively, and when the sub plate 120 fixed to the casing 10, the cylinder 130 and the main plate 110 may be bolt-fastened to the sub plate 120.

A sub shaft receiving portion 122 may be disposed at a center of the sub plate 120 to protrude downward, and a sub shaft receiving hole 123 may be disposed at the sub shaft receiving portion 122 to pass therethrough on a same axial line as the main shaft receiving hole 113. A lower end of the rotary shaft 30 may be supported by the sub shaft receiving hole 123.

The cylinder 130 may be formed in a circular annular shape with a same inner diameter on an inner circumferential surface thereof. An inner diameter of the cylinder 130 may be larger than an outer diameter of the roller 141 to define the compression space (V) between an inner circumferential surface of the cylinder 130 and an outer circumferential surface of the roller 141. Accordingly, the inner circumferential surface of the cylinder 130, the outer circumferential surface of the roller 141, and the vane 145 may define an outer wall surface of the compression space (V), an inner wall surface of the compression space (V), and a side wall surface of the compression space (V), respectively. Therefore, as the roller 141 performs an orbiting movement, the outer wall surface of the compression space (V) may define a fixed wall while the inner wall surface and the side wall surface of the compression space (V) define a variable wall whose position is variable.

A suction port 131 may be disposed in the cylinder 130, a vane slot 132 may be disposed at one circumferential side of the suction port 131, and a discharge guide groove 133 may be disposed at an opposite side of the suction port 131 with the vane slot 132 interposed therebetween. The suction port 131 may pass therethrough in a radial direction, and be connected to a suction pipe 12 passing through the casing 10. Accordingly, refrigerant may be suctioned into the compression space (V) of the cylinder 130 through the suction pipe 12 and the suction port 131.

The vane slot 132 may be defined in an elongated manner on an inner circumferential surface of the cylinder 130 in a direction toward an outer circumferential surface thereof. An inner circumferential side of the vane slot 132 is open, and an outer circumferential side thereof is closed. The vane slot 132 may have a width approximately equal to a thickness or width of the vane 145 to allow the vane 145 of the vane roller 140, which will be hereinafter, to slide therein. Accordingly, both side surfaces of the vane 145 are supported by both inner wall surfaces of the vane slot 132 to slide approximately linearly.

The discharge guide groove 133 may be defined in a chamfered shape at an inner edge of the cylinder 130. The discharge guide groove 133 may serve to guide refrigerant compressed in the compression space of the cylinder to the discharge port 114 of the main plate 110. However, as the discharge guide groove 133 generates a dead volume, the discharge guide groove should not be provided as necessary, and if the discharge guide groove is provided, a volume thereof should be kept to a minimum.

Referring to FIG. 3, the vane roller 140 may include a roller 141 and a vane 145 as described above. The roller 141 and the vane may be a single body or may be coupled to each other to allow relative movement. The embodiment will be described based on an example in which the roller and the vane are rotatably coupled to each other.

The roller 141 may be rotatably inserted into and coupled to eccentric portion 35 of the rotary shaft 30, and the vane 145 may be slidably coupled to the vane slot 132 of the cylinder 130 and hinge-coupled to an outer circumferential surface of the roller 141. Accordingly, the roller 141 may perform an orbiting movement inside of the cylinder 130 by the eccentric portion 35 during rotation of the rotary shaft 30, and the vane may reciprocate in a state of being coupled to the roller 141.

The roller 141 may be defined in a cylindrical shape having a predetermined diameter and thickness. For example, the roller 141 may be defined in an annular shape to have an inner diameter such that an inner circumferential surface thereof may be in sliding contact with an outer circumferential surface of the eccentric portion 35 of the rotary shaft 30. A thickness of the roller 141 may have a thickness sufficient to secure a sealing distance to a hinge groove 1414, which will be described hereinafter.

Hinge groove 1414 may be disposed on the outer circumferential surface of the roller body 1411 so that a hinge protrusion 1452 of the vane 145, which will be described hereinafter, may be inserted to rotate. The hinge groove 1414 will be described hereinafter.

The vane 145 may include a vane body 1451, hinge protrusion 1452, and an interference avoiding surface 1453. The vane body 1451 may be defined in a flat plate shape having a predetermined length and thickness. For example, the vane body 1451 may be defined in a rectangular hexagonal shape as a whole. In addition, the vane body 1451 may be defined by a length such that the vane 145 remains in the vane slot 132 even when the roller 141 is completely moved to an opposite side of the vane slot 132.

The hinge protrusion 1452 may extend to a front end portion of the vane body 1451 facing the roller 141. The hinge protrusion 1452 may be inserted into the hinge groove 1414 and have a rotatable cross-sectional area. The hinge protrusion 1452 may be defined in a substantially circular cross-sectional shape except for a semicircular or connecting portion to correspond to the hinge groove 1414.

The interference avoiding surface 1453 is a portion disposed to prevent the vane body 1451 from interfering with an axial edge of the hinge groove 1414 when the vane 145 rotates with respect to the roller 141. Accordingly, the interference avoiding surface 1453 may be disposed in a direction in which an area between the vane body 1451 and the hinge protrusion 1452 decreases. The interference avoiding surface 1453 may be defined in a wedge cross-sectional shape or in a curved cross-sectional shape, for example.

Reference numerals 150 and 152 on the drawing denote a discharge valve and a muffler, respectively, and 130 denotes a discharge pipe.

The foregoing rotary compressor according to an embodiment operates as follows.

When power is applied to the electric motor unit 20, the rotor 22 of the electric motor unit 20 is rotated to rotate the rotary shaft 30. Then, the roller 141 of the vane roller 140 coupled to the eccentric portion 35 of the rotary shaft 30 rotates to suction refrigerant into the compression space (V) of the cylinder 130. The refrigerant repeats a series of processes of being compressed by the roller 141 and the vane 145 of the vane roller 140 and discharged into the inner space 11 of the casing 10 through the discharge port 114 provided in the main plate 110.

At this time, in a rolling piston type, a gap between the roller 141 and the vane 145 is increased by a vane jumping phenomenon generated during operation, and refrigerant leakage between compression chambers may be generated through the increased gap. In contrast, in a hinge vane type as according to an embodiment, the vane jumping phenomenon may be suppressed to reduce refrigerant leakage in the compression space.

However, as described above, in the rotary compressor, due to its characteristics, the roller 141 is tilted about its axial center by a compression reaction force such that both axial cross-sections of the roller 141 collide with or press against an axial side surfaces of the main plate 110 and an axial side surface of sub plate 120. Further, the roller 141 is thermally deformed as a temperature of the compression space rises, and the thermally deformed roller 141 is tilted in an axial direction by the compression reaction force to further strongly collide with or press against the main plate 110 or the sub plate 120.

In particular, in a hinge vane type in which the vane 145 is coupled to the roller 141 as in the embodiment, the roller 141 is constrained by the vane 145 such that a specific portion on an axial cross section of the roller 141 continues to perform an orbiting movement while being pressed against an axial side surface of the main plate 110 or the sub plate 120. Then, an axial top or bottom edge of the roller 141 scratches an axial side surface of the main plate 110 or sub plate 120 defining a compression space, wearing out the axial top or bottom edge of the roller or an axial side surface of the main plate 110 or an axial side surface of the sub plate 120. The worn-out portion is opened, generating refrigerant leakage in the compression space during operation of the compressor and reducing compression efficiency or foreign substances may be generated during the process of scratching the plate by the roller, causing wear on a different bearing surface or contact surface.

Thus, in the embodiment, wear avoiding portions or gap maintaining portions or chamfered portions may be disposed on axial end surfaces of the roller or axial side surfaces of the main plate and the sub plate facing the axial end surfaces of the roller. Hereinafter, it will be referred to as a wear avoiding portion as a unified term.

Figure 4:
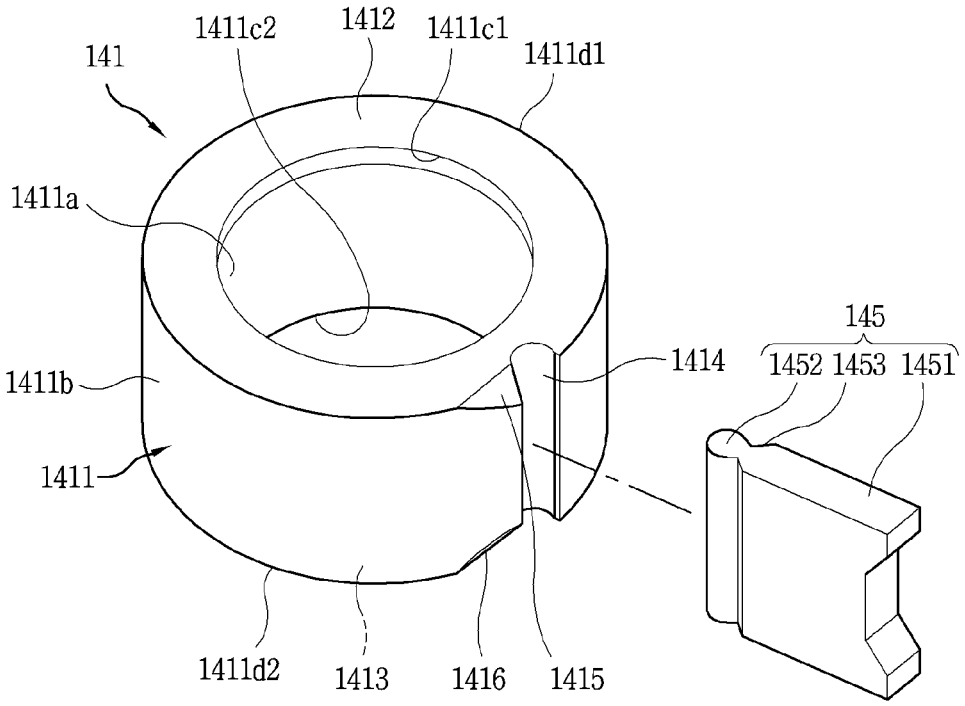
FIG. 4 is an exploded perspective view showing a roller and a vane in a vane roller according to an embodiment.
Figure 5:
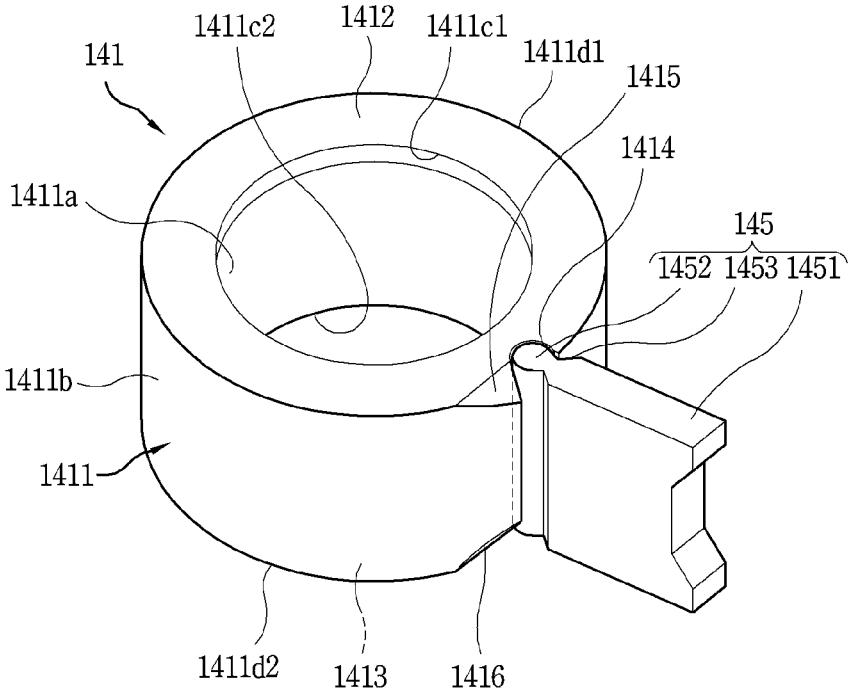
FIG. 5 is an assembled perspective view showing the roller and the vane in the vane roller of FIG. 4.

FIG. 4 is an exploded perspective view showing a roller and a vane in a vane roller according to an embodiment. FIG. 5 is an assembled perspective view showing the roller and the vane in the vane roller of FIG. 4.

Referring to FIG. 4, the vane roller 140 according to an embodiment may include a roller 141, and a vane 145 hinge-coupled to the roller 141, as described above. The roller 141 may include a roller body 1411, a sealing surface 1412, 1413, a hinge groove 1414, and a wear avoiding portion 1415, 1416.

The roller body 1411 may be defined in a cylindrical shape. An axial height of the roller body 1411 may be approximately equal to an inner circumferential height of the cylinder 130. However, as the roller 141 must slide relative to the main plate 110 and the sub plate 120, the axial height of the roller body 1411 may be slightly smaller than the inner circumferential height of the cylinder 130.

Further, the inner circumferential height and the outer circumferential height of the roller body 1411 may be substantially the same. Accordingly, both axial cross-sections connecting the inner circumferential surface and the outer circumferential surface of the roller body 1411 may define the sealing surfaces 1412, 1413 described above, and the sealing surfaces 1412, 1413 may be perpendicular to the inner or outer circumferential surface of the roller body 1411.

The sealing surfaces 1412, 1413 are surfaces facing an axial side surface of the main plate 110 or an axial side surface of the sub plate 120, and may be disposed in parallel to each axial side surface. Hereinafter, description will be given by defining the axial side surface of the main plate 110 as a first thrust surface 1111, and the axial side surface of the sub plate 120 as a second thrust surface 1211, and defining a surface facing the first thrust surface 1111 as a first sealing surface 1412 and a surface facing the second thrust surface 1211 as a second sealing surface 1413 between the sealing surfaces 1412, 1413. Radial lengths of the first sealing surface 1412 and the second sealing surface 1413 may be defined to ensure a sealing length capable of suppressing refrigerant in compression chamber (V) from being leaked toward the inner circumferential surface of the roller body 1411.

In addition, an inner edge **1411*c*1, 1411*c*2 connecting inner circumferential surface 1411*a* of the roller body 1411 and the sealing surface 1412, 1413 or an outer edge 1411*d*1, 1411*d*2 connecting outer circumferential surface 1411*b* of the roller body 1411 and the sealing surface 1412, 1413** may be at a right angle, or may be slightly inclined or curved. Hereinafter, a case where the edge is at a right angle will be described as an example, but the description may also be similarly applicable to a case where the edge is an inclined or curved surface.

The hinge groove 1414 may be axially elongated so as to connect the first sealing surface 1412 and the second sealing surface 1413 of the roller body 1411. The hinge groove 1414 may be defined in an arc shape in a planar projection. For example, the hinge groove 1414 may be defined in a semi-circular cross-sectional shape, but is defined to have a larger arc length than the semi-circle to prevent hinge protrusion 1452 from being released.

As shown in FIG. 5, the wear avoiding portion 1415, 1416 is disposed on at least one of the first sealing surface 1412 and the second sealing surface 1413. More precisely, the wear avoiding portion 1415, 1416 is disposed to have a predetermined depth at an outer edge thereof.

The wear avoiding portion 1415, 1416 according to the embodiment will be described with an example in which the wear avoiding portions are disposed on both sealing surfaces located at both axial sides thereof. In addition, when it is required to distinguish a wear avoiding portion disposed on the first sealing surface from a wear avoiding portion disposed on the second sealing surface below, description will be given by defining a wear avoiding portion disposed at an outer edge 1411*d*1 including the first sealing surface 1412 as a first wear avoiding portion 1415, and a wear avoiding portion disposed at an outer edge 1411*d*2 including the second sealing surface 1413 as a second wear avoiding portion 1416. However, when it is not required to distinguish the first wear avoiding portion from the second wear avoiding portion, it will be collectively referred to as a wear avoiding portion.

The wear avoiding portion 1415, 1416 may prevent the first sealing surface 1412 and the second sealing surface 1413 of the roller 141 from colliding with or pressing against the first thrust surface 1111 of the main plate 110 or the second thrust surface 1211 of the sub plate 120 when the roller 141 is inclined or inclined with respect to a shaft center during operation of the compressor. In the rotary compressor according to the embodiment, a discharge pressure is defined at a portion defining a discharge chamber (V2) based on the vanes 145. The roller 141 is subject to the greatest compression reaction force at a portion belonging to a range of the discharge chamber (V2) and tilted to a greatest extent.

In particular, when the roller 141 is constrained to the vane 145 not to rotate as in the embodiment, a specific portion of the roller 141, that is, a circumference of the hinge groove 1414 coupled to the vane 145, is tilted to the greatest extent to collide with or press against the main plate 110 or the sub plate 120. Therefore, the wear avoiding portion 1415, 1416 may be disposed at a portion defining discharge chamber (V) or at a position closest to the portion defining the discharge chamber (V) on the sealing surface of the roller 141. Based on the hinge groove 1414 to which the vane 145 is coupled, the vane 145 may include the hinge groove 1414 or be disposed around the hinge groove 1414.

Figure 6:
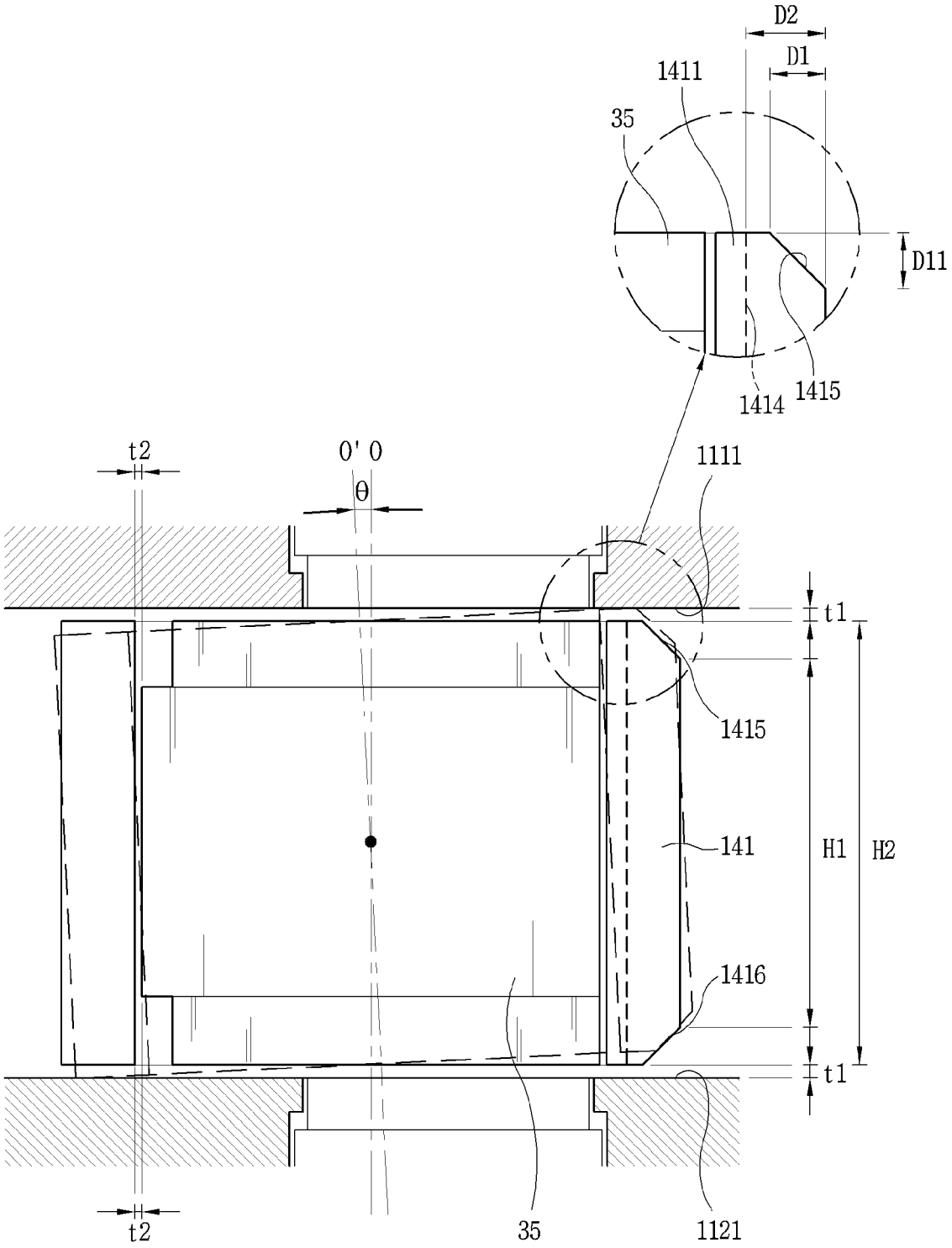
FIG. 6 is a schematic view for explaining a wear avoiding portion according to an embodiment.

On the other hand, the position of the wear avoiding portion according to the embodiment may be defined in consideration of a tilting amount and thermal deformation amount of the roller. FIG. 6 is a schematic view for explaining a specification of a wear avoiding portion according to an embodiment. For reference, a gap between members illustrated in FIG. 6 is exaggerated.

Referring to FIG. 6, the wear avoiding portion 1415, 1416 may be disposed at the outer edge 1411*d*1, 1411*d*2 of the roller body 1411 in consideration of the tilting amount of the roller 141. For example, when a distance between the sealing surfaces 1412, 1413 of the roller 141 and the first thrust surface 1111 of the main plate 110 facing the roller 141 or the second thrust surface 1211 of the sub plate 120 is referred to as a first gap (t1), and a distance between the inner circumferential surface 1411*a* of the roller body 1411 and an outer circumferential surface 35*a* of the eccentric portion 35 of the rotary shaft 30 facing this is referred to as a second gap (t2), the roller is tilted with respect to shaft center (O) by a predetermined angle (θ) during operation of the compressor due to the first and second gaps.

Then, as described above, when the roller 141 is tilted, the outer edge 1411*d*1, 1411*d*2 firstly collides with or presses against the first thrust surface 1111 of the main plate 110 or the second thrust surface of the sub plate 120. Accordingly, the wear avoiding portion 1415, 1416 may be disposed at the outer edge 1411*d*1, 1411*d*2 rather than the inner edge 1411*c*1, 1411*c*2 of the roller 141 or disposed to include at least the outer edge 1411*d*1, 1411*d*2. This is the same even when taking the thermal deformation amount, which will be described, into consideration.

The wear avoiding portion 1415, 1416 may be disposed in consideration of thermal deformation. In other words, the first gap (t1) described above may be primarily defined by the second gap (t2). However, the first gap (t1) is not always constant along a circumferential direction of the roller 141. In particular, during operation of the compressor, thermal deformation is generated by compression heat, and the thermal deformation may be differently defined according to a circumferential position of the roller 141.

For example, the roller 141 may have a larger amount of thermal deformation at a portion defining the discharge chamber (V2) than at a portion defining suction chamber (V1). Therefore, the first gap (t1) may be narrowest at a portion where the discharge chamber (V2) is located, based on the circumferential direction of the roller 141. The narrowest first gap (t1) denotes that the roller is most likely to press against the plate at that portion, and thus, the wear avoiding portion 1415, 1416 may be disposed at a portion where thermal deformation occurs at the largest scale.

As a result, the wear avoiding portion 1415, 1416 may be disposed at a portion having a largest compression reaction force and a portion having a largest thermal deformation amount based on the circumferential direction of the roller 141. This portion of the roller 141 belongs to a range that defines the discharge chamber (V2) as described above. Accordingly, with respect to the hinge groove 1414, the wear avoiding portion 1415, 1416 according to the embodiment may be disposed at a side at which the discharge port 114 of the main plate 110 is provided between both circumferential directions of the hinge groove 1414.

Figure 7:
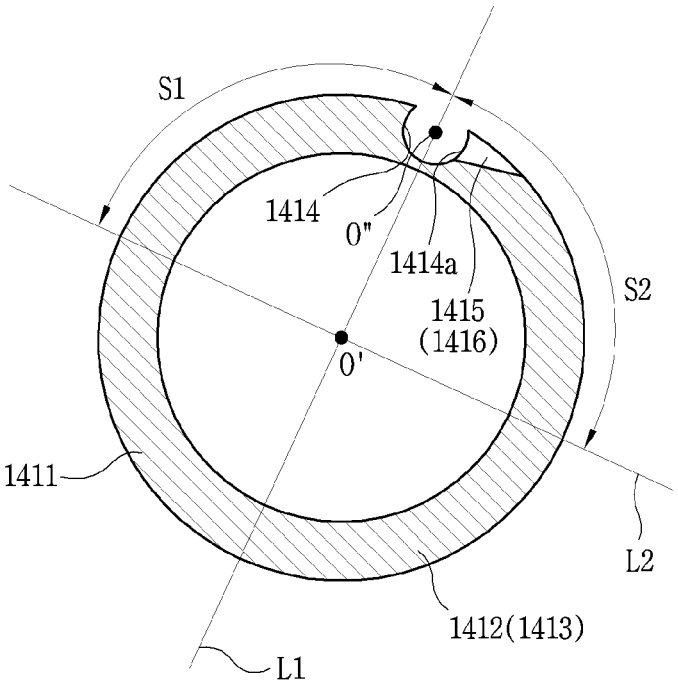
FIG. 7 is a schematic view showing a roller at an upper axial side thereof to explain a position of the wear avoiding portion according to an embodiment.

FIG. 7 is a schematic view showing a roller at an upper axial side thereof to explain a position of the wear avoiding portion according to an embodiment. Referring to FIG. 7, a line passing through center (O') of the roller 141 and center (O") of the hinge groove 1414 may be referred to as a first imaginary line (L1), and the center, and a line orthogonal to the first imaginary line (L1) may be referred to as a second imaginary line (L2), and the sealing surfaces 1412, 1413 of the roller 141 may be divided into four quadrants by the first imaginary line (L1) and the second imaginary line (L2) in planar projection. The wear avoiding portion 1415, 1416 may be disposed in a range of quadrants adjacent to the hinge groove 1414 (hereinafter, the quadrants are defined as a first quadrant and a second quadrant).

Accordingly, on the sealing surface 1412, 1413 of the roller 141 according to the embodiment, when a portion belonging to the first quadrant adjacent to the hinge groove 1414 is referred to as a first portion (S1) based on the hinge groove 1414, and a portion belonging to the second quadrant adjacent to the hinge groove 1414 is referred to as a second portion (S2), and the first portion (S1) defines the suction chamber (V1) and the second portion (S2) defines the discharge chamber (V2) in the compression space (V), the wear avoiding portion 1415, 1416 is disposed at the second portion (S2). The second portion (S2) having the discharge chamber (V2) defines a space having a higher pressure than the first portion (S1) having the suction chamber (V1). Accordingly, as the second portion (S2) is more thermally deformed than the first portion (S1), the wear avoiding portion 1415, 1416 may be disposed at the second portion (S2) rather than the first portion (S1).

Further, the wear avoiding portion 1415, 1416 according to the embodiment may be disposed as close as possible to a shortest distance from the hinge groove 1414 or disposed to communicate with the hinge groove 1414. As described above, the compression space may be divided into a plurality of spaces, that is, the suction chamber (V1) and the discharge chamber (V2) by the vane 145, and the amount of tilting and thermal deformation at a point closest to the vane 145 is the largest. Therefore, it is advantageous that the wear avoiding portion 1415, 1416 is disposed to extend up to the inner circumferential surface 1414*a* of the hinge groove 1414 for reducing wear due to tilting and thermal deformation of the roller 141.

Referring again to FIGS. 5 and 6, a first height (H1), which is an axial height in the wear avoiding portion 1415, 1416, may be lower than a second height (H2), which is an axial height at a portion outside of the wear avoiding portion 1415, 1416, and the hinge protrusion 1452 of the vane 145 may have a same height as the second height (H2) of the roller 141 is inserted into the hinge groove 1414. Therefore, even when the wear avoiding portion 1415, 1416 extends to the hinge groove 1414 to reduce the height of the roller body 1411 at the hinge groove 1414, a space defining the discharge chamber (V2) and a space defining the suction chamber (V1) may be blocked by the hinge protrusion 1452 to suppress refrigerant leakage between the compression chambers.

However, a radial depth (D1) of the wear avoiding portion 1415, 1416 may be smaller than or equal to a radial depth (D2) of the hinge groove 1414. If the radial depth (D1) of the wear avoiding portion 1415, 1416 is greater (deeper) than the radial depth (D2) of the hinge groove 1414, the wear avoiding portion 1415, 1416 may be out of a range of the hinge groove 1414. The wear avoiding portion 1415, 1416 at a portion outside the hinge groove 1414 is out of a range of the vanes 145, and thus, the wear avoiding portion 1415, 1416 acts as a type of refrigerant passage between the compression chambers. Then, refrigerant in the space having the discharge chamber (V2) leaks into a space having the suction chamber (V1), thereby causing compression loss. Accordingly, the radial depth (D1) of the wear avoiding portion 1415, 1416 may be within the radial depth (D2) of the hinge groove 1414.

A maximum avoiding gap of the wear avoiding portion 1415, 1416 may be greater than or equal to a maximum tilting gap at which the roller 141 may be tilted with respect to the eccentric portion 35. The maximum avoiding gap is determined by a axial depth of the wear avoiding portion. The axial depth of the wear avoiding portions according to the embodiment may be defined differently or identically along the circumferential direction.

Figure 8:
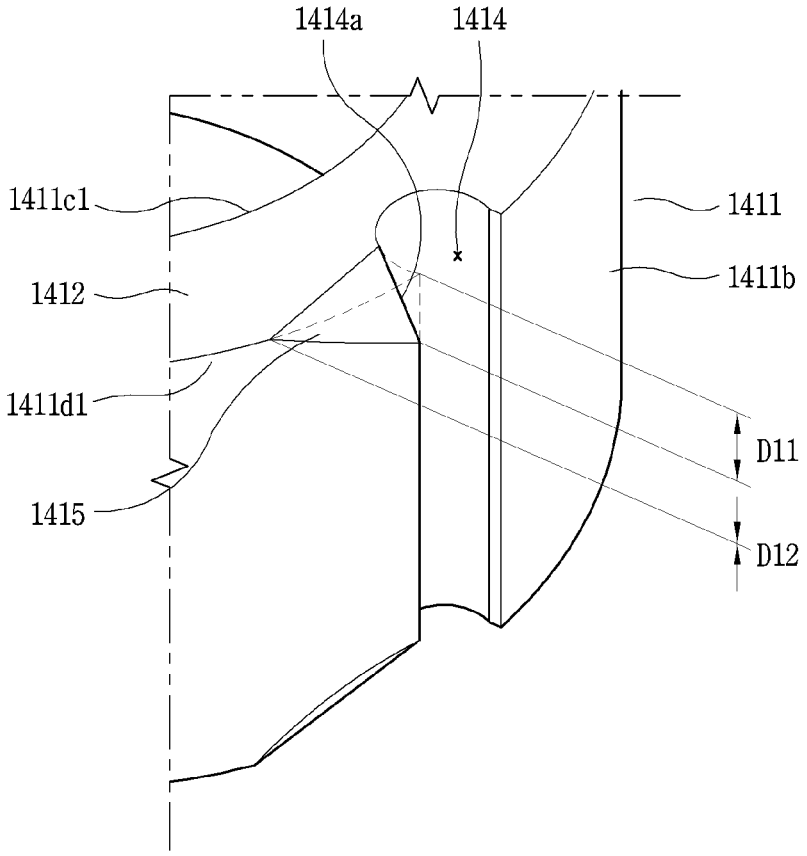
FIGS. 8 and 9 are enlarged views to explain a shape of the wear avoiding portion according to an embodiment.
Figure 9:
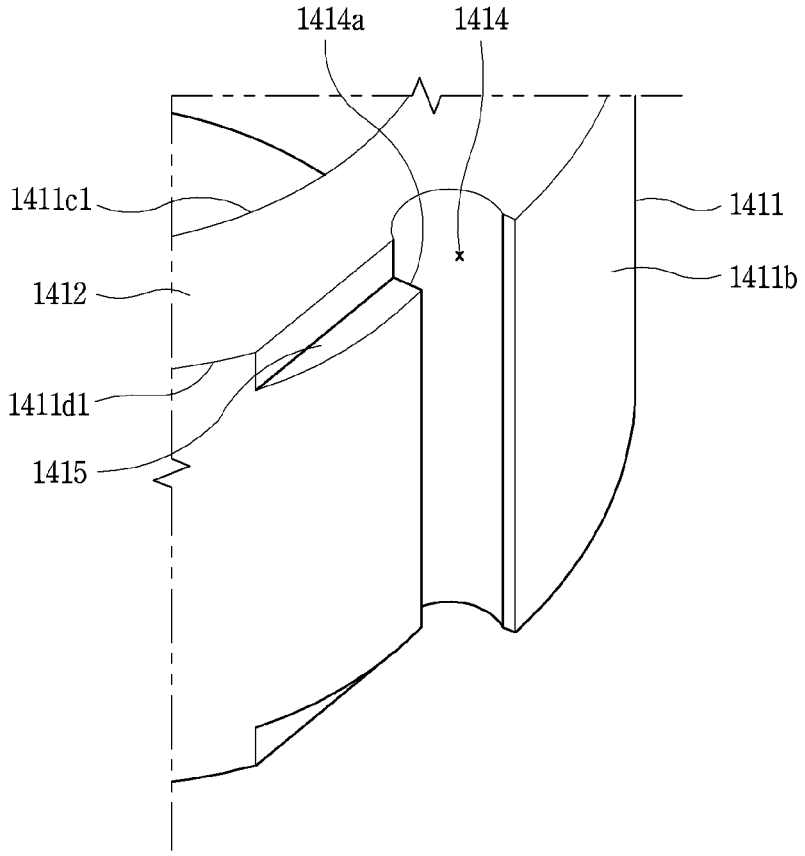

FIGS. 8 and 9 are enlarged views to explain a shape of the wear avoiding portion according to an embodiment. In these drawings, for convenience of description, the first wear avoiding portion will be mainly described, but the second wear avoiding portion may be the same as the first wear avoiding portion.

Referring to FIG. 8, the first wear avoiding portion 1415 may be defined by obliquely chamfering the outer edge 1411*d*1 of the roller body 1411. A depth of a portion constituting a circumferential center of the first wear avoiding portion 1415 may be defined to be deepest. In other words, a circumferential depth of the first wear avoiding portion 1415 may be defined such that a central depth (D11), which is a portion adjacent to the hinge groove 1414, is deeper than an end depth (D12) away from the hinge groove 1414. A first height (H1), which is an axial height of the roller body 141 of the roller body 1411 at a center of the first wear avoiding portion 1415, may be smaller than a second height (H2), which is an axial height of the roller body 1411 at a portion outside of the first wear avoiding portion 1415.

As described above, the tilting amount and the thermal deformation amount around a discharge side of the hinge groove 1414 may be largest. Therefore, the circumferential center of the first wear avoiding portion 1415, which is the deepest portion on the first wear avoiding portion 1415, may be disposed at a position corresponding to a discharge-side inner circumferential surface 1414*a* of the hinge groove 1414. The first wear avoiding portion 1415 may have an approximately half-inverted triangle shape with a front projection based on the first wear avoiding portion 1415 provided on the first sealing surface 1412. Therefore, the second wear avoiding portion 1416 provided on the second sealing surface 1413 of the roller 141 may be defined in an approximately half triangle shape with a front projection.

When the vane body 1451 is hinge-coupled to the roller body 1411 as described above, an upper or lower vertex where an outer edge 1411*d*1, 1411*d*2 of the roller body 1411 and an edge of the hinge groove 1414 are in contact with each other may press against the first thrust surface 1111 of the main plate 110 or the second thrust surface 1211 of the sub plate 120, located at both axial sides, respectively. However, in the embodiment, as the deepest center of the wear avoiding portion 145, 1416 is located at a discharge-side inner circumferential surface 1414*a* or a discharge-side inner circumferential surface edge of the hinge groove 1414, the outer edge 1411*d*1, 1411*d*2 of the roller 141 is not brought into contact with the main plate 110 or the sub plate 120 by the wear avoiding portions 145, 1416 even when the roller 141 is tilted by an allowance with respect to the eccentric portion 35 of the rotary shaft 30, or not strongly pressed even when brought into contact therewith.

Referring to FIG. 9, the wear avoiding portion 1415, 1416 according to the embodiment may be defined in a stepped manner at the outer edge 1411*d*1, 1411*d*2 of the roller body 1411. In this case, as the axial depth or radial depth of the wear avoiding portion 1415, 1416 is processed similarly in a circumferential direction, it may be advantageous in processing.

However, even when the wear avoiding portion 1415, 1416 is defined in a stepped manner, the axial depth or radial depth of the wear avoiding portion 1415, 1416 may be defined differently along the circumferential direction as in the previous embodiment. Further, if the wear avoidance portions 1415 and 1416 have the same axial depth or radial depth, defining the wear avoidance portions 1415 and 1416 in a step manner increases an overall volume and depth at the stepped portion compared to defining them in an inclined manner. Then, a thermal deformation amount at the stepped wear avoiding portion is relatively lower than at the inclined wear avoiding portion. The maximum avoidance gap may be further increased by reducing a decrease of the avoidance gap due to thermal deformation during operation.

A wear avoiding portion in the rotary compressor according to another embodiment will be described hereinafter. In the previous embodiment, the wear avoiding portion is disposed only at one circumferential side around the sealing groove, but in this embodiment, the wear avoiding portions are disposed at both circumferential sides around the sealing groove.

Figure 10:
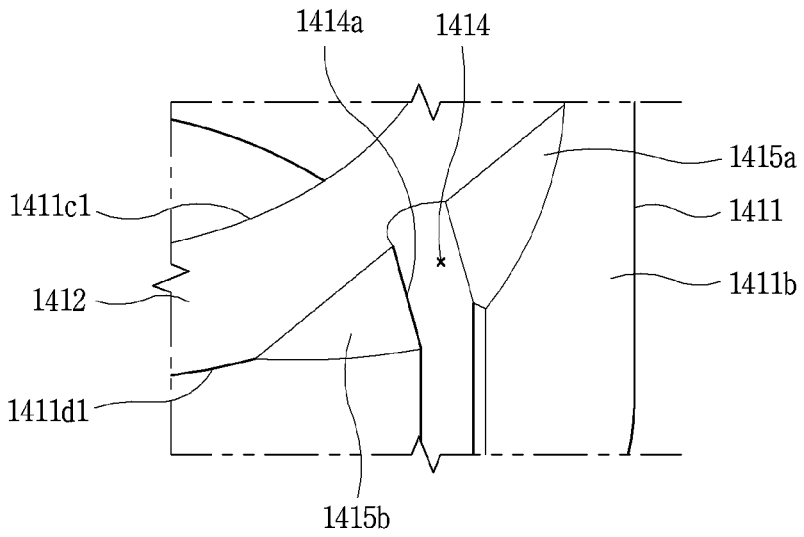
FIGS. 10 through 12 are perspective views of a wear avoiding portion of a vane roller according to still another embodiment.
Figure 11:
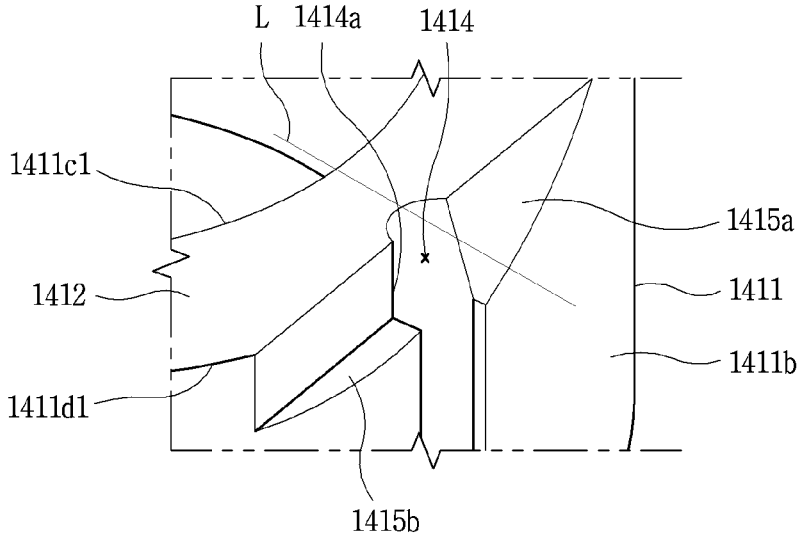
Figure 12:
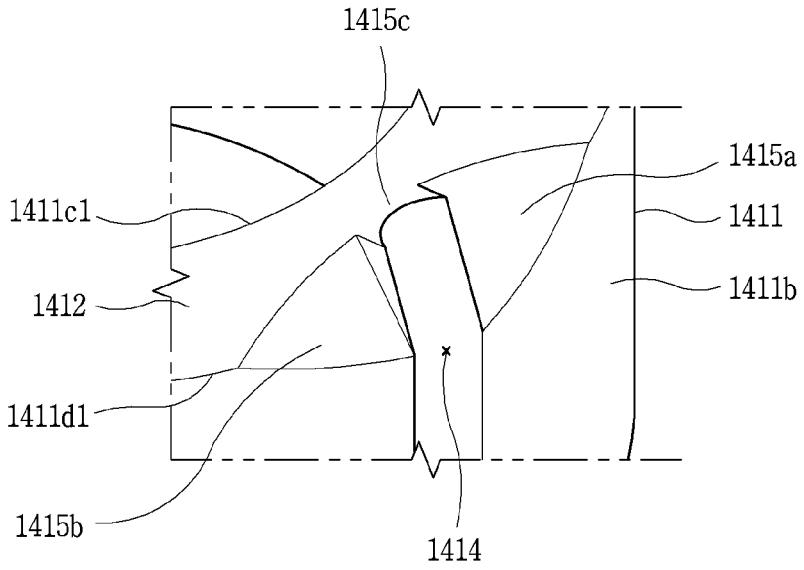

FIGS. 10 through 12 are perspective views of a wear avoiding portion of a vane roller according to still another embodiment. Even in these drawings, the first wear avoiding portion will be mainly described, but the second wear avoiding portion may be the same.

Referring to FIGS. 10 and 11, the first wear avoiding portion 1415 according to the embodiment may be disposed over first portion (S1) on a suction side and second portion (S2) on a discharge side of the roller body 1411. For the first wear avoiding portion 1415, a wear avoiding portion disposed at the first portion (S1) with respect to first imaginary line (L1) may be defined as a suction-side wear avoiding portion 1415*a* and a wear avoiding portion disposed at the second portion (S2) is defined as a discharge-side wear avoiding portion 1415*b*.

The suction-side wear avoiding portion 1415*a* and the discharge-side wear avoiding portion 1415*b* may have a same shape or different shapes. FIG. 10 is a view illustrating a case where the suction-side wear avoiding portion 1415*a* and the discharge-side wear avoiding portion 1415*b* are symmetrical.

In a case where the suction-side wear avoiding portion 1415*a* and the discharge-side wear avoiding portion 1415*b* are defined in the same shape, both the wear avoiding portions 1415*a*, 1415*b* may be formed in a single process, thereby facilitating processing. However, as described above, as the roller body 1411 has a larger amount of thermal deformation at the second portion (S2) compared to the first portion (S1), the amount of wear at the second portion (S2) may be greater than that at the first portion (S1) even when the first portion (S1) and the second portion (S2) of the roller body 1411 are tilted at a substantially same angle around the hinge groove 1414, In consideration of this, as shown in FIG. 11, the suction-side wear avoiding portion 1415*a* and the discharge-side wear avoiding portion 1415*b* may have different shapes. For example, the suction-side wear avoiding portion 1415*a* may be defined in an inclined manner while the discharge-side wear avoiding portion 1415*b* may be defined in a stepped manner.

As described above, in a case of having a same area and same axial depth, the stepped wear avoiding portion may secure a larger thermal deformation margin than the inclined wear avoiding portion. Therefore, it may be advantageous that the discharge-side wear avoiding portion 1415*b* provided at the second portion (S2) having a relatively large thermal deformation amount is defined in a stepped manner.

The suction-side wear avoiding portion 1415*a* may be defined in an inclined manner such that the inclined side blocks a portion of the stepped side, thereby suppressing refrigerant leakage between the suction chamber (V1) and the discharge chamber (V2) defined in both spaces, respectively, around the vane 145.

In addition, as shown in FIG. 12, a partition wall portion or wall 1415*c* may be disposed between the suction-side wear avoiding portion 1415*a* and the discharge-side wear avoiding portion 1415*b*. The partition wall portion 1415*c* may be defined by the suction-side wear avoiding portion 1415*a* and the discharge-side wear avoiding portion 1415*b* spaced apart from each other with the hinge groove 1414 interposed therebetween. In this case, the suction-side wear avoiding portion 1415*a* and the discharge-side wear avoiding portion 1415*b* may be defined in a same shape or may be defined in different shapes. When the suction-side wear avoiding portion 1415*a* and the discharge-side wear avoiding portion 1415*b* are identical to each other, both the wear avoiding portions 1415*a*, 1415*b* may be easily formed, and when the suction-side wear avoiding portion 1415*a* and the discharge-side wear avoiding portion 1415*b* have different shapes, the wear avoiding portions may be appropriately selected according to conditions.

Another embodiment of the wear avoiding portion will be described hereinafter. In other words, in the previous embodiments, the first wear avoiding portion provided on the first sealing surface and the second wear avoiding portion provided on the second sealing surface may be symmetric with each other in shape and size, but the first wear avoiding portion and the second wear avoiding portion may be asymmetric in shape and size. In this embodiment, the first wear avoiding portion and the second wear avoiding portion may be defined differently according to respective conditions.

Figure 13:
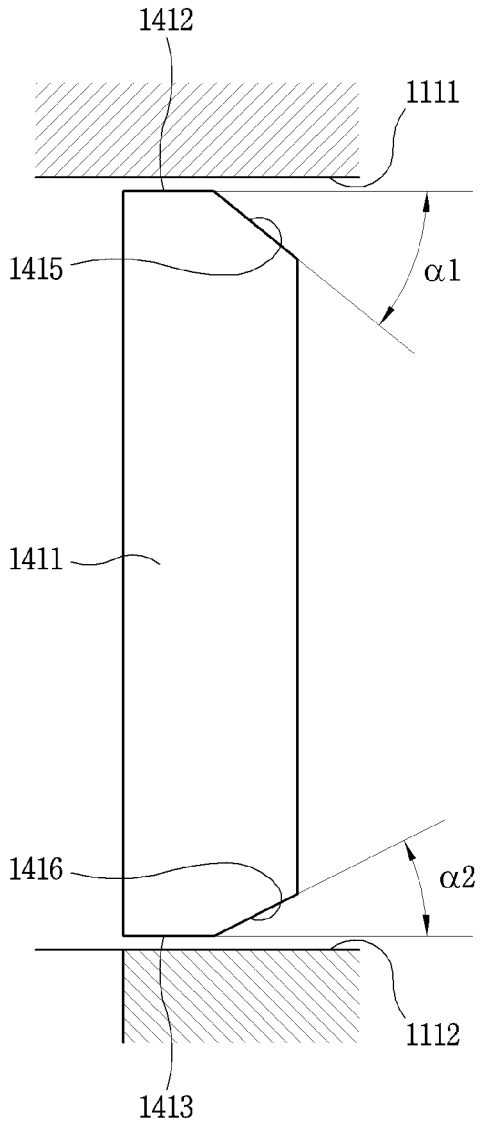
FIGS. 13 and 14 are schematic views of a first wear avoiding portion and a second wear avoiding portion of avane roller according to still another embodiment.
Figure 14:
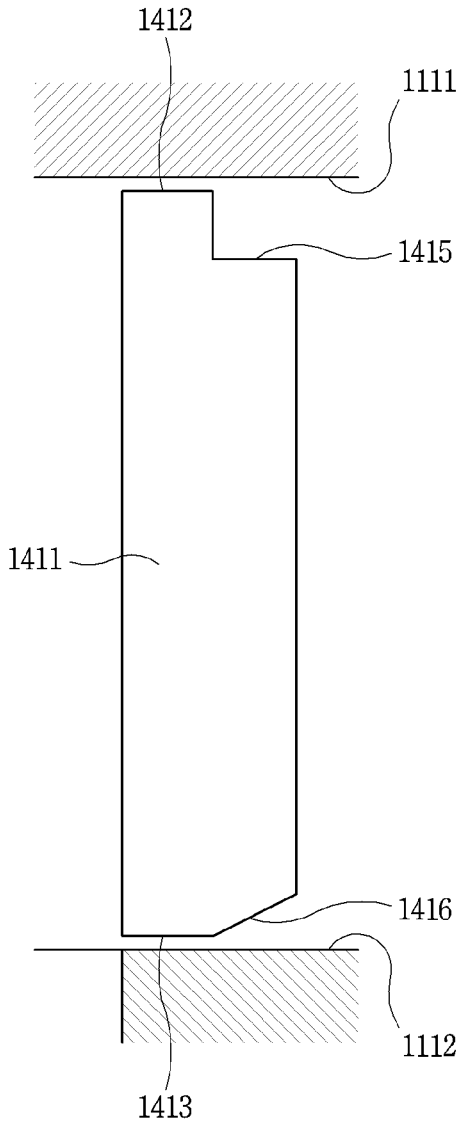

FIGS. 13 and 14 are schematic views of a first wear avoiding portion and a second wear avoiding portion of a vane roller according to still another embodiment. Referring to FIG. 13, an axial depth of the first wear avoiding portion 1415 may be greater than an axial depth of the second wear avoiding portion 1416. To this end, when the first wear avoiding portion 1415 and the second wear avoiding portion 1416 are defined in the same shape, an inclination angle ($\alpha$1) of the first wear avoiding portion 1415 may be larger than an inclination angle ($\alpha$2) of the second wear avoiding portion 1416. Of course, although not shown in the drawings, when the wear avoiding portion is defined in a stepped manner, a step depth of the first wear avoiding portion may be greater than that of the second wear avoiding portion.

Referring to FIG. 14, the first wear avoiding portion 1415 and the second wear avoiding portion 1416 may have different shapes. For example, the first wear avoiding portion 1415 may be defined in a stepped shape, and the second wear avoiding portion 1416 may be defined in an inclined shape.

A basic construction of the first wear avoiding portion 1415 and the second wear avoiding portion 1416 and effects thereof may be substantially the same as those of the previous embodiments. Therefore, repetitive description thereof has been omitted.

However, in a case of defining axial depths of the first wear avoiding portion 1415 and the second wear avoiding portion 1416 to be different, as in the embodiment, though the thermal deformation amounts of the first sealing surface 1412 of the roller 141 and the second sealing surface 1413 in the roller 141 are different from each other, a gap on the first sealing surface 1412 and a gap on the second sealing surface 1413 with respect to each plate 110, 120 may be maintained approximately constant. In other words, as the discharge port 114 is disposed adjacent the first wear avoiding portion 1415, the roller 141 adjacent to the discharge port 114 has a thermal deformation amount on the first sealing surface 1412 greater than that on the second sealing surface 1413 located away from the discharge portion 114. However, as an axial depth of the first wear avoiding portion 1415 may be larger than that of the second wear avoiding portion 1416 as in the previous embodiments, a degree of pressing or an amount of wear due to a difference in thermal deformation may be compensated. Then, a gap on the first sealing surface 1412 and a gap on the second sealing surface 1413 with respect to each of the plates 110, 120 may be maintained substantially constant.

A rotary compressor according to another embodiment will be described hereinafter.

In other words, in the previous embodiment, the wear avoiding portion is disposed on the first sealing surface and the second sealing surface of the roller, respectively, but in this embodiment, the wear avoiding portion is disposed on an axial side surface of the main plate and/or an axial side surface of the sub plate facing the first sealing surface and the second sealing surface of the roller.

Figure 15:
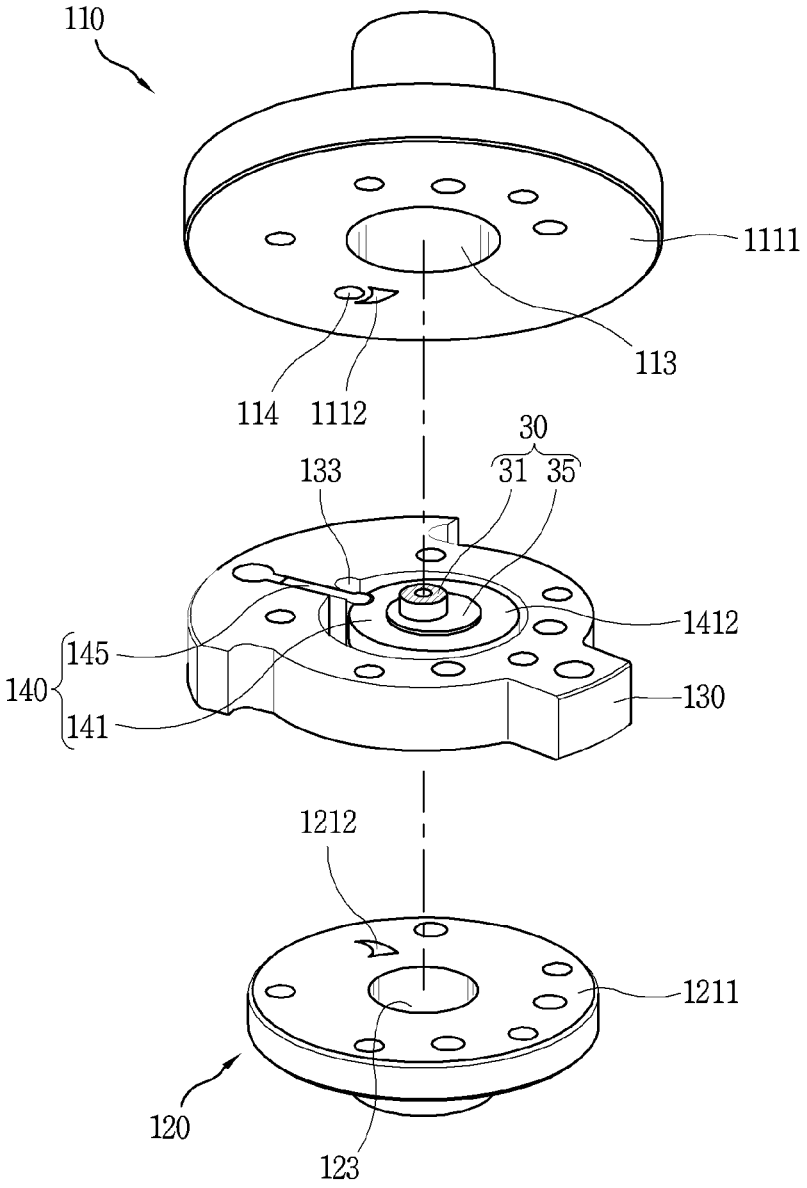
FIG. 15 is an exploded perspective view of a compression unit in a rotary compressor according to another embodiment.
Figure 16:
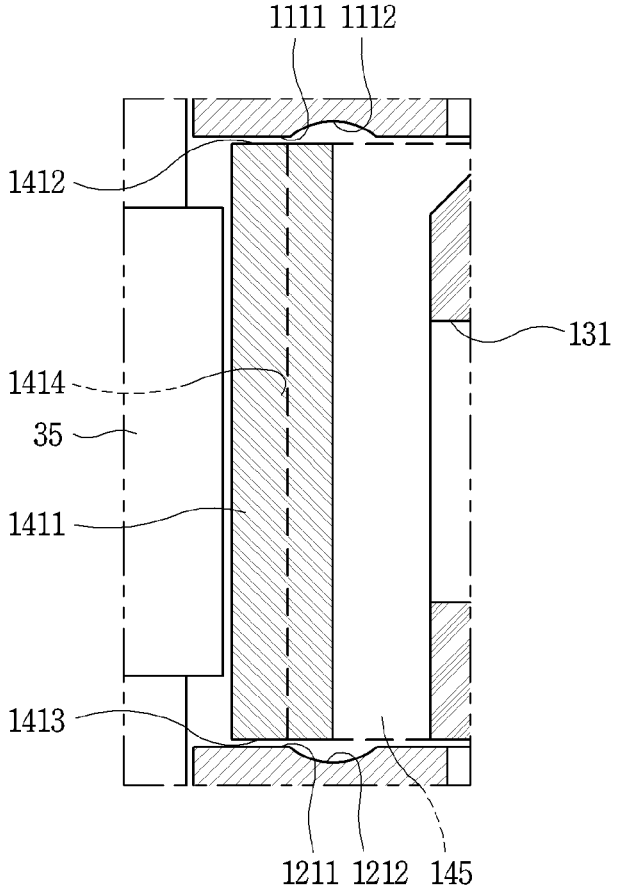
FIG. 16 is a cross-sectional view showing a portion of the roller by assembling the compression unit of FIG. 15.

FIG. 15 is an exploded perspective view of a compression unit in a rotary compressor according to another embodiment. FIG. 16 is a cross-sectional view showing a portion of the roller by assembling the compression unit of FIG. 15.

Referring to FIGS. 15 and 16, a first wear avoiding portion 1112 is disposed on the first thrust surface 1111 of the main plate 110, and a second wear avoiding portion 1212 is disposed on a second thrust surface 1211 of the sub plate 120. A structure and effects thereof for the wear avoiding portion according to this embodiment are substantially the same as those of the wear avoiding portion described in the previous embodiments. Therefore, the detailed description thereof has been omitted. However, as the first wear avoiding portion 1112 in the wear avoiding portions according to this embodiment is disposed on the first thrust surface provided with the discharge port, a relationship between the first wear avoiding portion 1111 and the discharge port 114 will be described hereinafter.

For example, the first wear avoiding portion 1112 according to this embodiment may be disposed at a position where the roller 141 passes while performing an orbiting movement in consideration of a trajectory of the roller 141. In this case, the first wear avoiding portion 1112 may be completely surround a circumference of the discharge port 114 or surround at least a portion thereof.

In addition, the first wear avoiding portion 1112 according to this embodiment may communicate with the discharge port 114. Accordingly, even though the roller 141 is tilted so that the first sealing surface 1412 of the roller 141 is close to the first thrust surface 1111 of the main plate 110, the first sealing surface 1412 of the roller 141 may be prevented from pressing against the first thrust surface 1111 of the main plate 110. In addition, the wear avoiding portion 1112 according to this embodiment may serve as a type of discharge guide groove as it communicates with the discharge port 114 to reduce discharge loss.

However, when a lateral cross-sectional area of the first wear avoiding portion 1112 is wide, for example, when a cross-sectional area of the discharge port is wider, the discharge port 114 and the first wear avoiding portion 1112 may be separated from each other. If the lateral cross-sectional area of the first wear avoiding portion 1112 is wide, refrigerant that has not reached discharge pressure may leak to the discharge port 114 through the first wear avoiding portion 1112. Accordingly, when a lateral cross-sectional area of the first wear avoiding portion 1112 is wide, the discharge port 114 and the first wear avoiding portion 1112 may be separated from each other.

On the other hand, although not shown in the drawings, the wear avoiding portions according to embodiments may be disposed on a sealing surface of the roller and a thrust surface facing the sealing surface, respectively. The basic configuration thereof is similar to the previous embodiments, and thus, repetitive description has been omitted.

In this way, even when the roller is tilted during operation of the compressor in a hinge vane type, the roller is prevented from colliding with or pressing against the plate to suppress a contact surface of the roller or the plate from being excessively in close contact with the roller. With this structure, friction loss between the roller and the plate may be reduced to enhance performance of the compressor, and wear of the roller or plate may be suppressed to improve reliability.

In addition, a recessed wear avoiding portion or gap maintaining portion or chamfered portion may be defined on an axial end surface of the roller or an axial side surface of the plate facing the same in a hinge vane type, but a size and position of the gap maintaining portion or gap maintaining portion or chamfered portion may be adjusted to suppress compression efficiency from being lowered by the wear avoiding portion or gap maintaining portion or chamfered portion.

In the described embodiments, a case where upper and lower edges of the roller are perpendicular has been described with reference to an example, but the foregoing wear avoiding portion may also be disposed even when the upper and lower edges of the roller are defined with annular inclined or annular curved surfaces along a circumferential direction. In other words, the sealing surface of the roller according to embodiments is an axial cross section perpendicular to an inner or outer circumferential surface of the roller, and the wear avoiding portion is disposed on the sealing surface of the roller. Therefore, when an annular inclined surface or an annular curved surface is defined at an upper or lower edge of the roller, the annular inclined surface or the annular curved surface does not correspond strictly to the sealing surface of the roller 141. Accordingly, when the annular inclined surface or the annular curved surface is defined at an upper edge or lower edge of the roller, the wear avoiding portion is defined to be deeper in an axial or radial direction than the annular inclined surface or the annular curved surface.

Further, the described embodiments have been mainly described with reference to an example in which the roller and the vane are rotatably coupled to each other, but the wear avoiding portion may also be similarly applicable to a case where the roller and the vane are formed as a single body. In addition, the described embodiments have been mainly described with reference to an an example applied to a vane roller type in which the roller and the vane are hinge-coupled to each other, but may also be applicable to a case where the roller and the vane are formed as a single body or a rolling piston type in which the vane is slidably in contact with an outer circumferential surface of the roller. However, in a rolling piston type, as the rolling piston is not constrained by the vanes, the wear avoiding portion may be respectively disposed at an axial side surface of the main plate or the sub plate facing both axial ends of the rolling piston.

The embodiments have been mainly described with reference to an example of one cylinder, but the wear avoiding portion may also be similarly applicable to a case having a plurality of cylinders.

According to a rotary compressor according to embodiments disclosed herein, wear avoiding portions or gap maintaining portions or chamfered portions that are axially recessed may be defined on both axial end surfaces of the roller or on axial side surfaces of the main plate and the sub plate facing the same in a hinge vane type. With this structure, it may be possible to prevent the roller from colliding with or pressing against the plate by tilting or thermal expansion of the roller generated during operation of the compressor. Further, a contact surface between the roller and the plate may be suppressed from being in close contact with each other to suppress the roller or the plate from being damaged or a performance of the compressor due to friction loss from being deteriorated, thereby improving reliability and performance of the compressor.

Also, according to embodiments disclosed herein, the wear avoiding portions or the gap maintaining portions or the chamfered portions may be defined on axial end surfaces of the roller or axial side surfaces of the plate facing the same in a hinge vane type, but the wear avoiding portions or the gap holding portions or chamfered portions may be defined at both sides, respectively, with a hinge groove interposed therebetween. With this structure, compression or wear around the hinge groove that may be generated by the roller constrained to the vane may be suppressed in a hinge vane type, thereby further enhancing reliability and performance of the compressor.

In addition, according to embodiments disclosed herein, the wear avoiding portions or the gap maintaining portions or the chamfered portions may be defined on axial end surfaces of the roller or axial side surfaces of the plate facing the same in a hinge vane type, but a size and position of the gap maintaining portions or the chamfered portions may be defined in consideration of a compression reaction force and thermal expansion amount thereof. With this structure, the possibility of contact at a portion where a tilting amount or a thermal deformation amount is relatively high may be reduced, thereby further enhancing reliability and performance of the compressor.

Moreover, according to embodiments disclosed herein, as a tilting phenomenon of the roller may be further generated when using a high-pressure refrigerant, such as R32, the wear avoiding portions or the gap maintaining portions or the chamfered portions described above may be usefully applied to a hinge vane type rotary compressor to which such a high-pressure refrigerant is applied. On the other hand, according to embodiments disclosed herein, as the tilting phenomenon of the roller may be further generated when using a high-pressure refrigerant, such as R32, the wear avoiding portions or the gap maintaining portions or the chamfered portions according to embodiments disclosed herein may be usefully applied to a hinge vane type rotary compressor to which such a high-pressure refrigerant is applied.

Embodiments disclosed herein provide a rotary compressor capable of suppressing a roller from colliding with or pressing against plates located at both axial sides of the roller in a hinge vane type. Further, embodiments disclosed herein provide a rotary compressor capable of defining a wear avoiding portion or a gap maintaining portion or a chamfered portion on an axial end surface of a roller or an axial side surface of a plate facing the same in the hinge vane type, thereby allowing the roller to avoid from colliding with or pressing against the plate even when the roller is tilted in an axial direction.

Embodiments disclosed herein provide a rotary compressor capable of defining a wear avoiding portion or a gap maintaining portion or a chamfered portion in consideration of the thermal deformation of a roller or a plate located at both axial ends of the roller, thereby allowing the roller to effectively avoid from excessively colliding with or pressing against the plate. Also, in view of the fact that a suction chamber and a discharge chamber are defined around the vane, embodiments disclosed herein provide a rotary compressor capable of defining a wear avoiding portion or a gap maintaining portion or a chamfered portion, thereby preventing refrigerant compressed by the wear avoiding portion or the maintaining portion or the chamfered portion from leaking in advance.

Embodiments disclosed herein provide a rotary compressor in which the vane is hinge-coupled to the roller, wherein a wear avoiding portion or a gap maintaining portion or a chamfered portion that is axially recessed is defined at an outer edge of the roller. An outer circumferential surface of the roller is defined with a hinge groove to which the vane is hinge-coupled, and the wear avoiding portion or the gap maintaining portion or the chamfered portion may communicate with the hinge groove.

The wear avoiding portion or the gap maintaining portion or the chamfered portion may be defined at a discharge side with respect to the hinge groove. The wear avoiding portion or the gap maintaining portion or the chamfered portion may be defined at a discharge side and a suction side, respectively, around or adjacent the hinge groove.

Embodiments disclosed herein provide a rotary compressor. An annular-shaped member and a plate-shaped member are hinge-coupled to an inside of a cylinder. The annular-shaped member is rotatably coupled to an eccentric portion of a rotary shaft. The plate-shaped member is slidably coupled to the cylinder. A space defining a suction pressure is formed at one or a first circumferential side, and a space defining a discharge pressure is formed at the other or a second circumferential side around the plate-shaped member. Wear avoiding portions or gap maintaining portions or chamfered portions that are axially recessed are defined at outer circumferential surface edges of both axial end surfaces of the annular-shaped member belonging to the space defining the discharge pressure.

A plurality of plates forming the space defining the suction pressure and the space defining discharge pressure together with the cylinder may be provided at both axial sides of the annular-shaped member, and one of the plurality of plates may be provided with a discharge port. A wear avoiding portion or a gap maintaining portion or a chamfered portion at a side facing the plate defined with the discharge port may shallower than a wear avoiding portion or a gap maintaining portion or a chamfered portion at an opposite side thereof.

Embodiments disclosed herein provided a rotary compressor in which the roller and the vane are coupled to each other. Wear avoiding portions or gap maintaining portions or chamfered portions are defined at both axial end surfaces of the roller. When an axial height of the roller between the wear avoiding portions or the gap maintaining portions or the chamfered portions is referred to as a first height, and an axial height of the roller at a portion where the wear avoiding portions or the gap maintaining portions or the chamfered portions are not defined is referred to as a second height, the first height is may be lower than the second height.

A hinge groove may extend along an axial direction so that the vane is rotatably coupled to an outer circumferential surface of the roller. The wear avoiding portion or the gap maintaining portion or chamfered portion may be less than or equal to a radial depth of the hinge groove.

Embodiments disclosed herein provide a rotary compressor that may include a drive motor; a rotary shaft that transmits a rotational force of the drive motor and has an eccentric portion; a cylinder provided at one side of the drive motor; a plurality of plates provided at both axial sides of the cylinder to define a compression space together with the cylinder; a roller coupled to an eccentric portion of the rotary shaft and defined with a hinge groove on an outer circumferential surface thereof; and a vane provided with a hinge protrusion rotatably coupled to a hinge groove of the roller by a predetermined angle to be movably coupled to the cylinder. An outer circumferential edge of both axial end surfaces of the roller or an axial side surface of the plate facing the roller may be defined in a chamfered or stepped manner.

Embodiments disclosed herein provide a rotary compressor that may include a rotary shaft; a plurality of plates that supports the rotary shaft; a cylinder provided between the plurality of plates to define a compression space, and provided with a vane slot; a roller slidably coupled to the rotary shaft to be provided inside of the cylinder, and having a hinge groove on an outer circumferential surface thereof; and a vane, one or a first end which is slidably coupled to the vane slot of the cylinder, and the other or a second end of which is rotatably coupled to the hinge groove of the roller. At least one of both axial end surfaces of the roller facing the plurality of plates may be provided with a wear avoiding portion having a preset depth.

The wear avoiding portion may connect an axial end surface of the roller and an outer circumferential surface thereof. Further, the wear avoiding portion may connect an axial end surface of the roller and an inner circumferential surface of the hinge groove.

A radial depth of the wear avoiding portion may be smaller than or equal to that of the hinge groove. An axial height on an outer circumferential surface of the roller may be defined such that a first height at a portion where the wear avoiding portion is disposed is lower than a second height at a portion where the wear avoiding portion is not disposed. An axial depth of the wear avoiding portion may be defined such that a center depth adjacent to the hinge groove is larger than an end depth away from the hinge groove.

The wear avoiding portion may be defined in an inclined or stepped manner in a circumferential direction of the roller. The wear avoiding portions may be disposed at both axial side surfaces of the roller, respectively. Further, the respective wear avoiding portions disposed at both axial sides of the roller may be symmetrical to each other with respect to an axial center of the roller. A maximum avoidance gap between the roller and the plate may be greater than or equal to a maximum tilting gap between the rotary shaft and the roller.

When a line passing through a center of the roller and passing through a center of the hinge groove is referred to as a first imaginary line, and a line passing through the center of the roller and orthogonal to the first imaginary line is referred to as a second imaginary line, and an axial plane of the roller is divided into four quadrants by the first imaginary line and the second imaginary line, the wear avoiding portion may be disposed within a range of a quadrant adjacent to the hinge groove. Further, when a portion of the roller that belongs to one quadrant adjacent to the hinge groove with respect to the hinge groove is referred to as a first portion, and a portion of the roller that belongs to another quadrant adjacent thereto is referred to as a second portion, the wear avoiding portion may be disposed at a portion belonging to a space having a higher pressure between the first portion and the second portion.

Embodiments disclosed herein provided a rotary compressor that may include a rotary shaft; a plurality of plates that supports the rotary shaft and having thrust surfaces; a cylinder provided between the plurality of plates to define a compression space, and provided with a vane slot; a roller coupled to the rotary shaft, both axial end surfaces of which respectively define sealing surfaces slidably brought into contact with the thrust surfaces of the plates; a vane, one or a first end of which is slidably coupled to the vane slot of the cylinder, and the other or a second end of which is hinge-coupled to the roller, and one or a first circumferential side of which defines a space having a suction pressure, and the other or a second circumferential side of which defines a space having a discharge pressure; and a wear avoiding portion disposed on at least one of the sealing surfaces of the roller or disposed on a thrust surface of at least one of the plurality of plates. At least a portion of the wear avoiding portion may include a space having the discharge pressure.

A discharge port may be disposed on either one of the plurality of plates, and the wear avoiding portions may be disposed on both sealing surfaces of the roller, respectively. An axial depth of a first wear avoiding portion, between the wear avoiding portions, disposed on a first sealing surface at a side facing a plate disposed with the discharge port may be greater than or equal to that of a second wear avoiding portion disposed on a second sealing surface at an opposite side thereof.

The wear avoiding portion may be disposed on a plate having the discharge port The wear avoiding portion may communicate with the discharge port.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and having a hinge groove on an outer circumferential surface thereof; and a vane, a first end which is slidably coupled to the vane slot of the cylinder, and a second end of which is rotatably coupled to the hinge groove of the roller, wherein at least one axial end surface of the roller facing the plurality of plates is provided with a wear avoiding portion having a predetermined depth, and wherein the wear avoiding portion connects the at least one axial end surface of the roller and an inner circumferential surface of the hinge groove.

2. The rotary compressor of claim 1, wherein the wear avoiding portion connects the at least one axial end surface of the roller and the outer circumferential surface of the roller.

3. The rotary compressor of claim 1, wherein a radial depth of the wear avoiding portion is smaller than or equal to a radial depth of the hinge groove.

4. The rotary compressor of claim 1, wherein an axial height of the outer circumferential surface of the roller is defined such that a first height at a portion at which the wear avoiding portion is disposed is lower than a second height at a portion at which the wear avoiding portion is not disposed.

5. The rotary compressor of claim 4, wherein an axial depth of the wear avoiding portion is defined such that a center depth adjacent to the hinge groove is larger than an end depth away from the hinge groove.

6. The rotary compressor of claim 4, wherein the wear avoiding portion is inclined or stepped in a circumferential direction of the roller.

7. The rotary compressor of claim 1, wherein the wear avoiding portion is provided at both axial end surfaces of the roller, respectively.

8. The rotary compressor of claim 7, wherein the wear avoiding portions disposed at both axial end surfaces of the roller are symmetrical to each other with respect to an axial center of the roller.

9. The rotary compressor of claim 1, wherein a maximum avoidance gap between the roller and a respective plate of the plurality of plates is greater than or equal to a maximum tilting gap between the rotary shaft and the roller.

10. The rotary compressor of claim 1, wherein when a line passing through a center of the roller and through a center of the hinge groove is referred to as a first imaginary line, and a line passing through the center of the roller and orthogonal to the first imaginary line is referred to as a second imaginary line, and an axial plane of the roller is divided into four quadrants by the first imaginary line and the second imaginary line, the wear avoiding portion is disposed within a range of a quadrant adjacent to the hinge groove.

11. The rotary compress of claim 10, wherein when a portion of the roller that belongs to one quadrant adjacent to the hinge groove with respect to the hinge groove is referred to as a first portion, and a portion of the roller that belongs to another quadrant adjacent thereto is referred to as a second portion, the wear avoiding portion is disposed at a portion belonging to a space having a higher pressure between the first portion and the second portion.

12. A rotary compressor, comprising:

a rotary shaft;

a plurality of plates that supports the rotary shaft and having thrust surfaces;

a cylinder provided between the plurality of plates to define a compression space, and provided with a vane slot;

a roller coupled to the rotary shaft, axial end surfaces of which respectively define sealing surfaces slidably brought into contact with the thrust surfaces of the plurality of plates;

a vane, a first end of which is slidably coupled to the vane slot of the cylinder, and a second end of which is hinge-coupled to the roller, and a first circumferential side of which defines a space having a suction pressure, and a second circumferential side of which defines a space having a discharge pressure;

a wear avoiding portion disposed on at least one of the sealing surfaces of the roller or disposed on the thrust surface of at least one of the plurality of plates, wherein at least a portion of the wear avoiding portion includes a space having the discharge pressure, wherein a discharge port is disposed on one of the plurality of plates, and the wear avoiding portion is disposed on both of the sealing surfaces of the roller, respectively, and wherein an axial depth of a first wear avoiding portion, of the wear avoiding portions, disposed on a first sealing surface, of the sealing surfaces, at a side facing the one of the plurality of plates having the discharge port is greater than or equal to an axial depth of a second wear avoiding portion, of the wear avoiding portions, disposed on a second sealing surface, of the sealing surfaces, at an opposite side thereof.

13. The rotary compressor of claim 12, wherein the wear avoiding portions are disposed on the one of the plurality of plates having the discharge port, and the wear avoiding portions communicate with the discharge port.

14. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and having a hinge groove on an outer circumferential surface thereof; and a vane, a first end which is slidably coupled to the vane slot of the cylinder, and a second end of which is rotatably coupled to the hinge groove of the roller, wherein at least one axial end surface of the roller facing the plurality of plates is provided with a wear avoiding portion in the form of an inclined or stepped cut out provided at an outer circumferential edge of the roller adjacent the hinge groove, wherein the wear avoiding portion is provided at both axial end surfaces of the roller, respectively, and wherein the wear avoiding portions disposed at both axial end surfaces of the roller are symmetrical to each other with respect to an axial center of the roller.

15. The rotary compressor of claim 14, wherein the wear avoiding portion connects the at least one axial end surface of the roller and an inner circumferential surface of the hinge groove.

16. The rotary compressor of claim 14, wherein a radial depth of the wear avoiding portion is smaller than or equal to a radial depth of the hinge groove.

* * * * *